US010851972B2

(12) United States Patent
Zeng

(10) Patent No.: US 10,851,972 B2
(45) Date of Patent: Dec. 1, 2020

(54) DETACHABLE LAMP ASSEMBLY

(71) Applicants: Self Electronics Co., Ltd., Zhejiang (CN); Wanjiong Lin, Zhejiang (CN); Self electronics USA Corporation, Norcross, GA (US)

(72) Inventor: Guoqing Zeng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/706,158

(22) Filed: Dec. 6, 2019

(65) Prior Publication Data

US 2020/0200370 A1 Jun. 25, 2020

(30) Foreign Application Priority Data

Dec. 25, 2018 (CN) ..... 2018 1 1596020

(51) Int. Cl.

| | |
|---|---|
| ***F21V 17/16*** | (2006.01) |
| ***F21V 17/12*** | (2006.01) |
| ***F21V 21/04*** | (2006.01) |
| *F21Y 115/10* | (2016.01) |
| *F21S 8/02* | (2006.01) |
| *F21V 17/14* | (2006.01) |

(52) U.S. Cl.

CPC ..... *F21V 17/16* (2013.01); *F21V 17/12* (2013.01); *F21V 21/04* (2013.01); *F21S 8/026* (2013.01); *F21V 17/14* (2013.01); *F21Y 2115/10* (2016.08)

(58) Field of Classification Search

CPC ..... F21S 8/02; F21S 8/026; F21S 8/04

See application file for complete search history.

(56) References Cited

U.S. PATENT DOCUMENTS

| | | | | |
|---|---|---|---|---|
| 4,763,231 | A * | 8/1988 | Houplain | F21V 19/0005 362/148 |
| 9,982,855 | B1 * | 5/2018 | Tan | F21V 17/12 |
| 2010/0259919 | A1 * | 10/2010 | Khazi | F21V 17/16 362/84 |
| 2014/0185302 | A1 * | 7/2014 | Ebisawa | F21V 21/04 362/311.01 |
| 2015/0153025 | A1 * | 6/2015 | Wu | F21V 14/06 362/282 |
| 2015/0292692 | A1 * | 10/2015 | Elmvang | F21V 7/22 362/294 |
| 2017/0343190 | A1 * | 11/2017 | Georgiev | F21V 17/02 |
| 2017/0343195 | A1 * | 11/2017 | Cadisch | F21V 21/30 |
| 2018/0156442 | A1 * | 6/2018 | Tseng | F21V 23/008 |
| 2019/0285261 | A1 * | 9/2019 | Ghasabi | F21S 8/026 |
| 2019/0301706 | A1 * | 10/2019 | Zhou | F21V 29/70 |

* cited by examiner

*Primary Examiner* — Zheng Song

(74) *Attorney, Agent, or Firm* — Wang Law Firm, Inc.

(57) ABSTRACT

A lamp has a lamp body assembly, a positioning frame assembly surrounding the periphery of the lamp body assembly for assembling the lamp body assembly to the fixture, the lamp body assembly is detachably assembled with the positioning frame assembly. The invention has the advantages of simple structure, low cost, convenient maintenance and can meet different requirements of lighting effect.

9 Claims, 3 Drawing Sheets

DETACHABLE LAMP ASSEMBLY

RELATED APPLICATION

This application claims priority to Chinese Patent Application No. CN 201811596020.4, filed on Dec. 25, 2018.

FIELD OF THE TECHNOLOGY

The present invention relates to lighting field, with particular emphasis on a lamp.

BACKGROUND OF THE INVENTION

In the assembly, the lamp generally needs to be fixed by additional components such as a face frame, that is, the lamp body assembly is fixedly connected with the face frame to form a complete lamp. In this fixed structure, when the lamp body component such as the LED light source breaks down, the entire lamp needs to be disassembled, the maintenance is inconvenient, and the cost is increased.

Moreover, the fixed structure causes a lamp to correspond to a lens or a filter. To achieve different illumination effects and obtain different spots, the entire lamp has to be replaced, resulting in waste of resources, which limits the scope of application of the lamp and further increases costs.

BRIEF SUMMARY OF THE INVENTION

In view of the above problems, an object of the present invention is to provide a lamp with simple structure, detachable, convenient maintenance, and low cost.

it is also an object of the present invention to provide a lamp capable of providing a plurality of illumination effects.

In particular, the invention relates to a lamp, comprising a lamp body assembly, a positioning frame assembly surrounding the periphery of the lamp body assembly for assembling the lamp body assembly to the fixture, characterized in that:

the lamp body assembly is detachably assembled with the positioning frame assembly.

Advantageously, the inner wall of the positioning frame assembly is provided with a groove formed along the circumferential direction of the positioning frame assembly, and the lamp body assembly is provided with a marble on the periphery that can be chimed with the groove to realize the connection between the lamp body assembly and the positioning frame assembly, and the marble drives the lamp body assembly to slide in the groove.

Advantageously, the lamp body assembly includes a lamp body and a fixing frame disposed on the outer wall of the lamp body and fixedly connected to the lamp body, and the marble is positioned on the fixing frame.

Advantageously, the lamp body includes a light-emitting cylinder, a light source located at a rear end of the light-emitting cylinder, and a lens assembly detachable at a front end of the light-emitting cylinder.

Advantageously, the lens assembly includes a lens located at the illumination end of the light source and connected with the light source main board, a decorative ring disposed at the light emitting end of the lens and matched with the inner wall of the light-emitting cylinder, and a detachable filter mounted on the decorative ring.

Advantageously, the inner wall of the decorative ring is provided with a carrying platform that is in contact with the light incident surface of the filter, and at least two bumps disposed above the carrying platform and in contact with the edge of the light exit surface of the filter to prevent the filter from falling off.

Advantageously, the side wall of the decorative ring above the carrying platform is separated by two slits facing the light incident end of the light-emitting cylinder to form an elastic wall, and one of the at least two bumps is located on the elastic wall.

Advantageously, the fixing frame is fixedly connected to the outer wall of the lamp body by a rivet.

Advantageously, the fixing frame is a fixing ring disposed around the periphery of the lamp body.

Advantageously, the positioning frame assembly is a ring like positioning frame, the opposite sides of the positioning frame assembly are provided with a pair of lugs for clamping.

Compared with the prior art, the invention has the advantages that the positioning frame assembly and the lamp body assembly are detachably connected, and when the lamp body assembly is damaged, the lamp body assembly can be directly removed for maintenance, and the maintenance is convenient; the sliding fit between the marble and the groove simplifies the assembly structure; the lens assembly is arranged in a detachable structure, and the filter is detachably disposed on the decorative ring, so that the lens or the filter can be replaced according to actual needs, thereby meeting different illumination effects, and the structure can be combined with the sliding setting of the positioning frame assembly and the lamp body assembly to further ensure the changing requirements of the illumination angle and realize different illumination requirements.

DETAILED DESCRIPTION OF THE INVENTION

Figure 1:
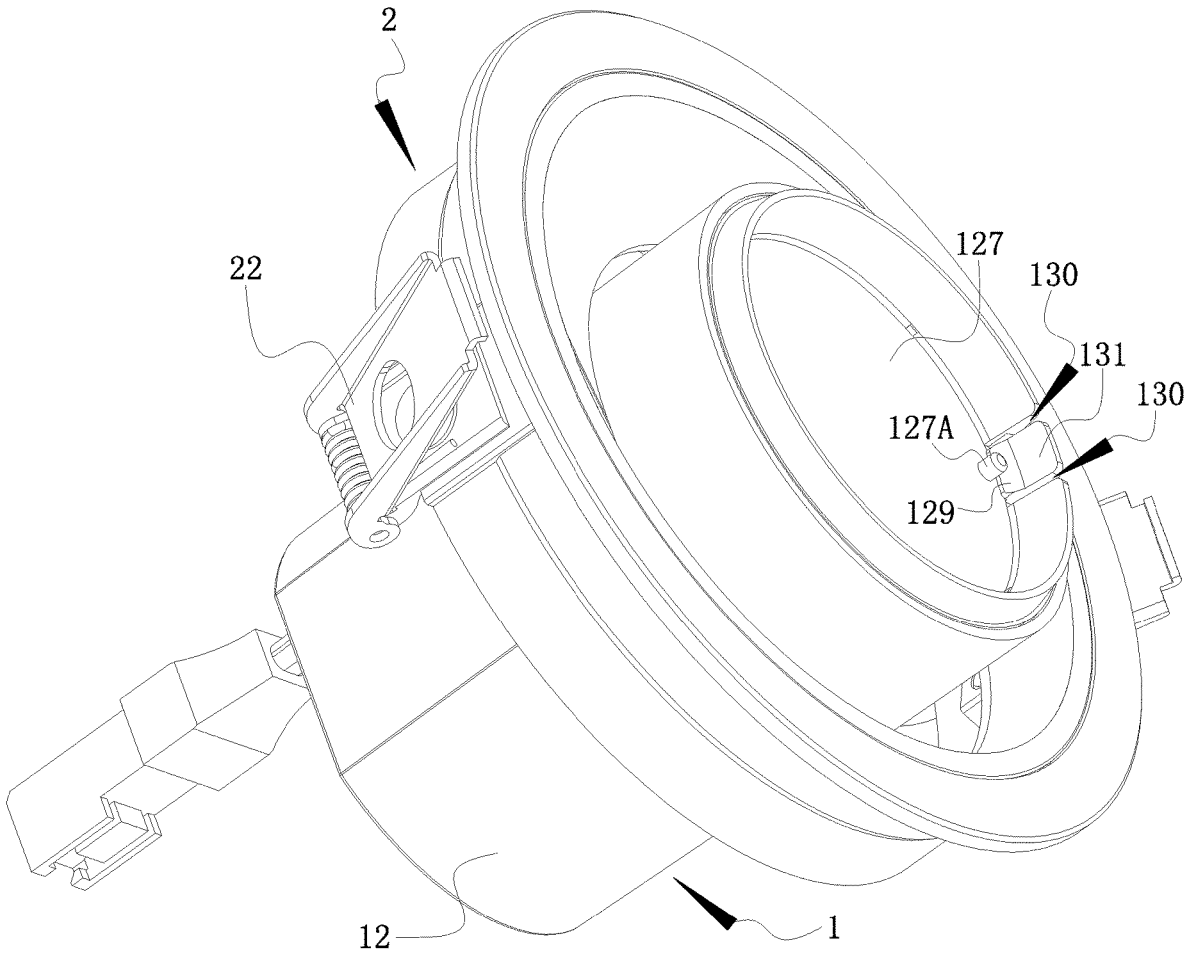
FIG. 1 is a schematic structural view of a lamp of the present application.

The present application is illustrated by way of the following detailed description based on of the accompanying drawings. It should be noted that illustration to the embodiment in this application is not intended to limit the invention. The embodiments of the present invention are described in detail below, and the examples of the embodiments are illustrated in the drawings, wherein the same or similar reference numerals are used to refer to the same or similar elements or elements having the same or similar functions. The embodiments described below with reference to the accompanying drawings are intended to be illustrative of the invention and are not to be construed as limiting.

Figure 2:
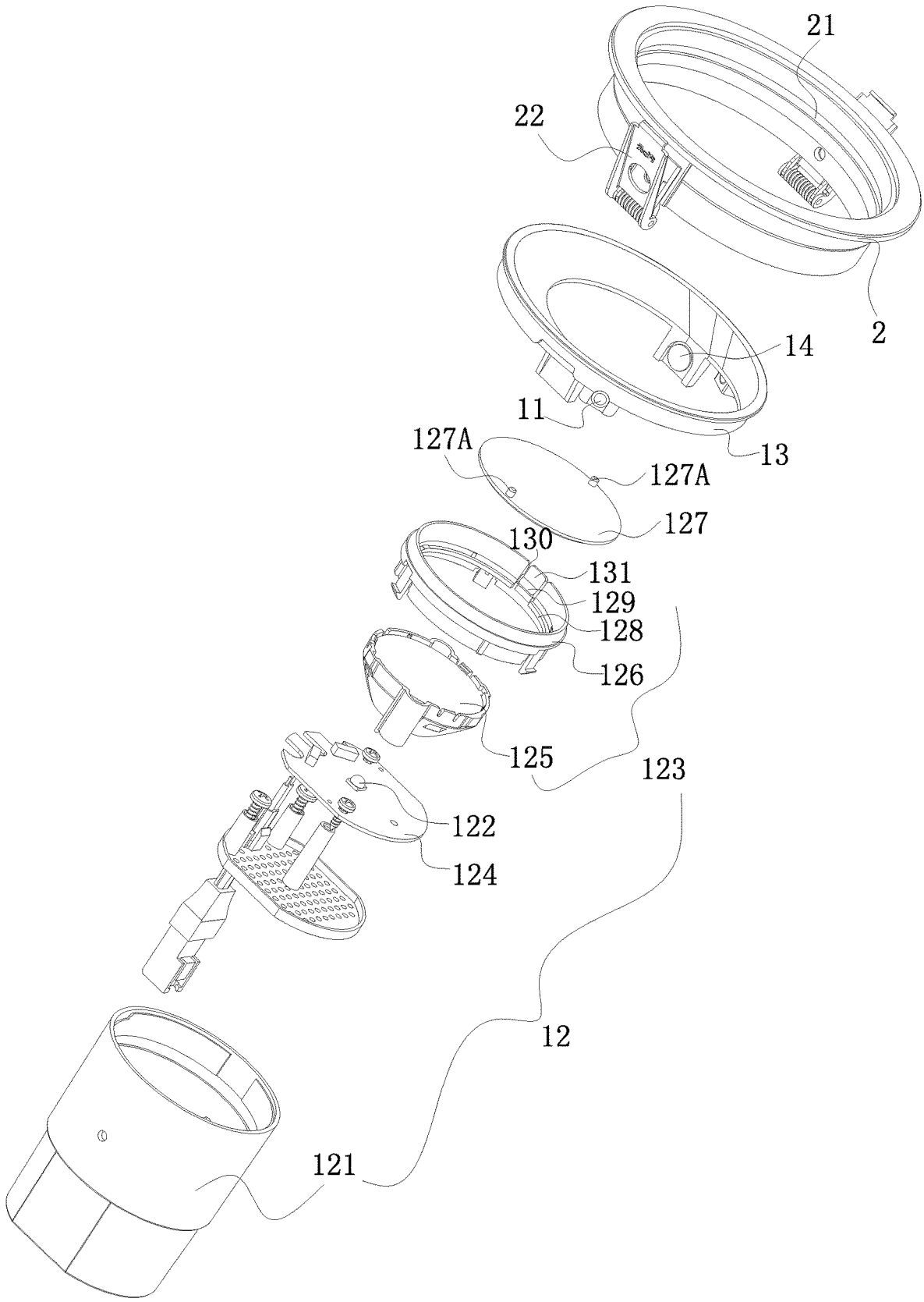
FIG. 2 is an exploded view of the lamp of the present application.
Figure 3:
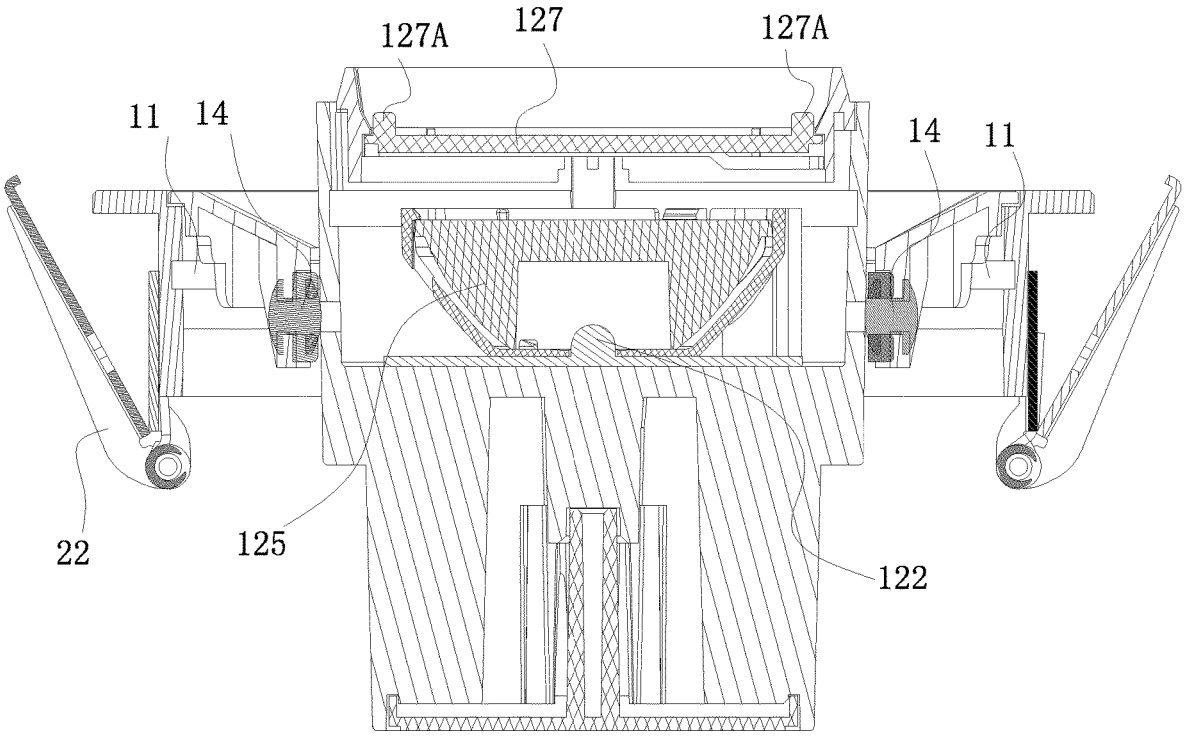
FIG. 3 is a cross-sectional view of the lamp of the present application.

FIG. 1-3 is a schematic structural view of a preferred embodiment of the lamp of the present application. The lamp comprises a lamp body assembly 1 and a positioning frame assembly 2 surrounding the outer periphery of the lamp body assembly 1 for assembling the lamp body assembly 1 to a fixture. The lamp body assembly 1 and the positioning frame assembly 2 are detachably assembled. Generally, this kind of lamp is commonly used in spotlight, down light, ceiling lamp, etc., but this kind of structure is not excluded for lamps of other uses. At the same time, the specific use of the lamps is not the focus of the protection of the present application, so it is not elaborated here.

As is well known, the positioning frame assembly serves as a connection medium between the lamp body assembly and the fixture surface, and the lamp body assembly is often fixed to the fixture surface by the positioning frame assembly. The existing positioning frame assembly and the lamp body assembly are generally welded or integrally formed. When the light source or other internal components in the lamp break down, it is necessary to remove the lamp from the fixture surface as a whole. In many cases, the positioning frame assembly is fixed by screw driven by the electric drill. If this operation is repeated many times, it will cause inconvenience in disassembly. At the same time, the mounting hole on the fixture will become larger due to repeated repetition of such operations, which will affect the fastness of assembly. In the present application, the positioning frame assembly and the lamp body assembly are designed to be detachably assembled, and in the event of a failure of the light source or the like, only the lamp body assembly needs to be removed for maintenance, which reduces maintenance troubles.

In this embodiment, referring to FIG. 2, the inner wall of the positioning frame assembly 2 is provided with a groove 21 formed along the circumferential direction of the positioning frame assembly 2, and the lamp body assembly 1 is provided with a marble 11 on the periphery that can be chimed with the groove 21 to realize the connection between the lamp body assembly 1 and the positioning frame assembly 2, and the marble 11 can drive the lamp body assembly 1 to slide in the groove 21. The structure is simple in design, reduces the production cost, and is convenient to install. When the light source in the lamp body assembly, namely the LED lamp, is broken, the entire lamp body assembly 1 can be pulled out from the groove 21, so that the marble 11 is separated from the groove 21, and only the lamp body assembly 1 needs to be repaired, reducing the maintenance cost. Moreover, the combination of marbles and grooves enables the lamp body assembly to have the rotating function, good hand feeling, even pull strength, which can effectively prevent the lamp body assembly from being damaged due to uneven force when pulling out from the grooves.

The lamp body assembly 1 includes a lamp body 12 and a fixing frame 13 disposed on the outer wall of the lamp body 12 and fixedly connected to the lamp body 12. The marble 11 is positioned on the fixing frame 13. The shape of the fixing frame 13 can be determined according to the actual situation, as long as the marble 11 is positioned on the fixing frame 13 and can cooperate with the groove 21.

Since the marble 11 is disposed on the fixing frame 13, when the marble 11 slides in the groove 21, the fixing frame 13 is likewise locked in the positioning frame assembly 2, and the fixing frame 13 is fixedly connected to the lamp body 12. In essence, the lamp body 12 rotates within the positioning frame assembly 2. It is conceivable that when the light emitted from the lamp body 12 is different, the lamp body 12 can be rotated within the positioning frame assembly 2 to achieve different illumination effects, which will be explained below.

The fixing frame 13 is fixedly connected to the outer wall of the lamp body 12 by the rivet 14 in this application, as shown in FIGS. 2 and 3, the fixing frame 13 is a fixing ring disposed around the periphery of the lamp body 12, and the positioning frame assembly 2 is ring like positioning frame.

Continue to refer to FIGS. 2 and 3, the lamp body 12 includes a light-emitting cylinder 121, a light source 122 located at the rear end of the light-emitting cylinder 121, and a lens assembly 123 detachable at the front end of the light-emitting cylinder 121. The lens assembly 123 comprises a lens 125 located at the illumination end of the light source 122 and connected with the light source main board 124 through screws, a decorative ring 126 fixed at the light emitting end of the lens 125 and matched with the inner wall of the light-emitting cylinder 121, and a detachable filter 127 mounted on the decorative ring 126.

The inner wall of the decorative ring 126 is provided with a carrying platform 128 that is in contact with the light incident surface of the filter 127, and at least two bumps 129 disposed above the carrying platform 128 and in contact with the edge of the light exit surface of the filter 127 to prevent the filter 127 from falling off. In the present application, the side wall of the decorative ring 126 above the carrying platform 128 is separated by two slits 130 facing the light incident end of the light-emitting cylinder 121 to form an elastic wall 131, and one of the at least two bumps 129 is located on the elastic wall 131. In order to facilitate the user to adjust the position and the mounting direction of the filter 127, and to facilitate the removal of filter, the light exit surface of the filter 127 is provided with a protrusion 127A for the finger to grip.

When assembling the filter 127, first insert the edge of the filter 127 between the other bump 129 and the corresponding carrying platform 128, and then open the elastic wall 131 apart outward in the radial direction, place the corresponding side edge of the filter 127 on the carrying platform 128 corresponding to the elastic wall 131, and then loose the elastic wall 131, and thus the bump 129 located on the elastic wall 131 cooperates with the carrying platform 128 to fix the filter 127; When removing the filter 127, open the elastic wall 131 and remove the filter 127 located below the elastic wall 131.

The filter 127 is designed as a detachable connection that can be achieved by simply replacing the filter with the required thickness when the user needs different lighting effects, without replacing the entire lamp body or even the entire lamp. The detachable connection of the lens assembly also makes it easy for the user to replace the lens and filter together and install other suitable lens assembly as required, thereby meeting the lighting requirements of different angles and effects, which not only reduces the stock of lamp accessories, reduces the inventory and cost pressure, and at the same time, combined with the function that the lamp body assembly 1 can rotate within the positioning frame assembly 2 with the cooperation of marble 11 and groove 21, but also expand the illumination angle adjustment range, thereby better realizing different illumination requirements, so as to achieve better illumination effect. The specific installation and fixation mode of the replaced lens assembly is similar to the above, which is not described here.

The opposite sides of the positioning frame assembly 2 in the present application are further provided with a pair of lugs 22 for clamping, which can be clamped and fixed with the fixture, such as when the lamp is a ceiling light, generally the hole is opened in the ceiling. The lug 22 is used to clamp the ceiling through the hole to secure the entire lamp.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A lamp, comprising a lamp body assembly (1) having a lamp body (12) and a fixing frame (13) disposed on an outer wall of the lamp body (12) which is fixedly connected to the lamp (12), a positioning frame assembly (2) surrounding a periphery of the lamp body assembly (1) for assembling the lamp body assembly (1) to a fixture, wherein:

the lamp body assembly (1) is detachably assembled with the positioning frame assembly (2), the lamp body (12) comprises a light-emitting cylinder (121), a light source (122) located at a rear end of the light-emitting cylinder (121), and a detachable lens assembly (123) at a front end of the light-emitting cylinder (121), the lens assembly (123) comprises a lens (125) at an illumination end of the light source (122) and connected to a light source main board (124), and a decorative ring (126) disposed at a light emitting end of the lens (125) which matches an inner wall of the light-emitting cylinder (121), wherein an inner wall of the decorative ring (126) has a carrying platform (128) in contact with a light incident surface of a filter (127), and at least two bumps (129) disposed above the carrying platform (128), a side wall of the decorative ring (126) is separated by two slits (13) facing a light incident end of the light-emitting cylinder (121) to form an elastic wall (131), and one of the at least two bumps (129) is located on the elastic wall (131).

2. The lamp as claimed in claim 1, wherein an inner wall of the positioning frame assembly (2) is provided with a groove (21) formed along a circumferential direction of the positioning frame assembly (2), and the lamp body assembly (1) has a marble (11) on the periphery that can be chimed with the groove (21) to connect the lamp body assembly (1) and the positioning frame assembly (2), and the marble (11) drives the lamp body assembly (1) to slide in the groove (21).

3. The lamp as claimed in claim 2, wherein the marble (11) is positioned on the fixing frame (13).

4. The lamp as claimed in claim 3, wherein the fixing frame (13) is fixedly connected to the outer wall of the lamp body (12) by a rivet (14).

5. The lamp as claimed in claim 3, wherein the fixing frame (13) is a fixing ring disposed around the periphery of the lamp body (12).

6. The lamp as claimed in claim 1, wherein the detachable filter (127) is mounted on the decorative ring (126).

7. The lamp as claimed in claim 1, wherein the at least two bumps (129) are in contact with an edge of a light exit surface of the filter (127) to prevent the filter (127) from falling off.

8. The lamp as claimed in claim 7, wherein the light exit surface of the filter (127) is provided with a protrusion (127A) for a finger to grip.

9. The lamp as claimed in claim 1, wherein the positioning frame assembly (2) is a ring like positioning frame, the opposite sides of the positioning frame assembly (2) are provided with a pair of lugs (22) for clamping.

* * * * *